US012690682B2

(12) United States Patent
Chen

(10) Patent No.: US 12,690,682 B2
(45) Date of Patent: Jul. 28, 2026

(54) SOFA STRUCTURAL FRAME AND SOFA THEREOF

(71) Applicant: Xuhui Chen, Huzhou (CN)

(72) Inventor: Xuhui Chen, Huzhou (CN)

( * ) Notice: Subject to any disclaimer, the term of this patent is extended or adjusted under 35 U.S.C. 154(b) by 142 days.

(21) Appl. No.: 18/815,896

(22) Filed: Aug. 27, 2024

(65) Prior Publication Data

US 2026/0060422 A1 Mar. 5, 2026

(51) Int. Cl.

| | |
|---|---|
| ***A47C 17/04*** | (2006.01) |
| ***A47C 1/032*** | (2006.01) |
| *A47C 4/02* | (2006.01) |
| *A47C 17/02* | (2006.01) |
| *A47C 17/68* | (2006.01) |

(52) U.S. Cl.

CPC ..... *A47C 1/032* (2013.01); *A47C 4/028* (2013.01); *A47C 17/02* (2013.01); *A47C 17/04* (2013.01); *A47C 17/68* (2013.01)

(58) Field of Classification Search

CPC ..... A47C 1/032; A47C 17/04; A47C 17/02; A47C 13/005; A47C 4/028; A47C 7/42

See application file for complete search history.

(56) References Cited

U.S. PATENT DOCUMENTS

| | | | | |
|---|---|---|---|---|
| 3,891,267 A * | 6/1975 | Taylor | A47C 1/026 297/344.21 |
| 6,692,079 B2 * | 2/2004 | Guillot | A47C 7/42 297/440.14 |
| 8,511,752 B2 * | 8/2013 | Grove | A47C 7/42 297/440.16 |

* cited by examiner

*Primary Examiner* — Syed A Islam
(74) *Attorney, Agent, or Firm* — Jose Cherson Weissbrot

(57) ABSTRACT

A sofa structural frame comprises a plurality of sofa modules, seat frame components, splicing pieces and supporting pieces which are combined to form a sofa frame, wherein the sofa modules comprise a backrest frame and armrests made by a molding process, the armrests are arranged on the two sides of the backrest frame by the splicing pieces, and the seat frame components are arranged between the armrests on two sides by the supporting pieces; connecting parts are formed on the surfaces of the armrest and the backrest frame; a mounting part is formed on the surface of the armrest; the splicing pieces comprise a first connector and a second connector which are connected with each other; the supporting pieces are configured to be connected with the mounting part and the seat frame component respectively in a clamping manner.

20 Claims, 8 Drawing Sheets

SOFA STRUCTURAL FRAME AND SOFA THEREOF

TECHNICAL FIELD

The present invention relates to the technical field of furniture, in particular to a sofa structural frame and a sofa thereof.

BACKGROUND

A primary part of the sofa frame is a traditional structure, which is usually a fixed frame structure connected by wooden screws. Especially, most upholstered sofa frames are traditional structures, mainly by cutting wood boards, cutting small pieces of wood, and strengthening and sealing edges by air nails, which become a wooden frame. During this period, there are many types of work and processes to complete, and there are large tolerance deviations and complex processes, which are suitable for product proofing and small batch production.

At present, as in U.S. Pat. No. 12,016,463, a sofa with a rotatable backrest is proposed, which includes a sofa seat frame, a backrest body and an extension mechanism. The backrest body is connected to the sofa seat frame through the extension mechanism. The sofa frame is connected by manual screws or bolts of a wooden frame, which will lead to large tolerances, multiple processes and a large amount of labor, so that the cost of products will rise due to the rising labor cost.

As for the improvement of industrial equipment and technology, it is found that the demand of the sofa inner frame structure can be quickly and accurately met by molding process, for example. Therefore a sofa structural frame is proposed, which can reduce wood consumption and deforestation by using plastic instead of wood, and make standard parts automatically produced by modular modules of building a sofa frame structure.

SUMMARY

The present invention provides a sofa structural frame, which includes a plurality of sofa modules, seat frame components, splicing pieces and supporting pieces which are combined to form a sofa frame, wherein the sofa modules include a backrest frame and armrests made by a molding process; the armrests are arranged on both sides of the backrest frame by the splicing pieces, and the seat frame components are arranged between the armrests on both sides by the supporting pieces; and connecting parts are formed on the surfaces of the armrests and the backrest frame, and a mounting part is formed on the surface of the armrest; the splicing pieces include a first connector and a second connector which are connected with each other; and the supporting pieces are configured to be respectively connected with the mounting part and the seat frame component in a clamping manner; and wherein, the first connector and the second connector are both configured to have a shape that is mutually matched with the connecting part and are connected with the connecting part in a clamping manner, and the supporting pieces are configured to have a shape that is mutually matched with the mounting part.

The present invention further provides a sofa structural frame, which includes a plurality of sofa modules constituting a sofa frame and splicing pieces installed on the sofa modules, wherein the splicing pieces are detachably connected; the surfaces of the sofa modules are formed with connecting parts through a molding process; the splicing pieces include splicing pieces and installation parts; the installation parts are all configured to have a shape that is matched with the connecting parts and are connected with the connecting parts in a clamping manner; and the splicing piece is detachably connected with the connecting part of another splicing piece through the connecting part.

The present invention further provides a sofa structure, which includes a sofa structural frame and a soft cladding arranged outside the sofa structural frame;

wherein the sofa structural frame includes a plurality of sofa modules, seat frame components, splicing pieces and supporting pieces which are combined to form a sofa frame, wherein the sofa modules include a backrest frame and armrests made by a molding process, the armrests are arranged on both sides of the backrest frame by the splicing pieces, and the seat frame components are arranged between the armrests on both sides by the supporting pieces; and connecting parts are formed on the surfaces of the armrests and the backrest frame, and a mounting part is formed on the surface of the armrest; the splicing pieces include a first connector and a second connector which are connected with each other; and the supporting pieces are configured to be respectively connected with the mounting part and the seat frame component in a clamping manner; and wherein, the first connector and the second connector are both configured to have a shape that is mutually matched with the connecting part and are connected with the connecting part in a clamping manner, and the supporting pieces are configured to have a shape that is mutually matched with the mounting part.

BRIEF DESCRIPTION OF DRAWINGS

In order to explain the technical scheme of this application more clearly, the drawings needed in the implementation will be briefly introduced below. Obviously, the drawings described below are only some implementations of this application. For those skilled in the art, other drawings can be obtained according to these drawings without creative work.

REFERENCE SIGNS

Figure 1:
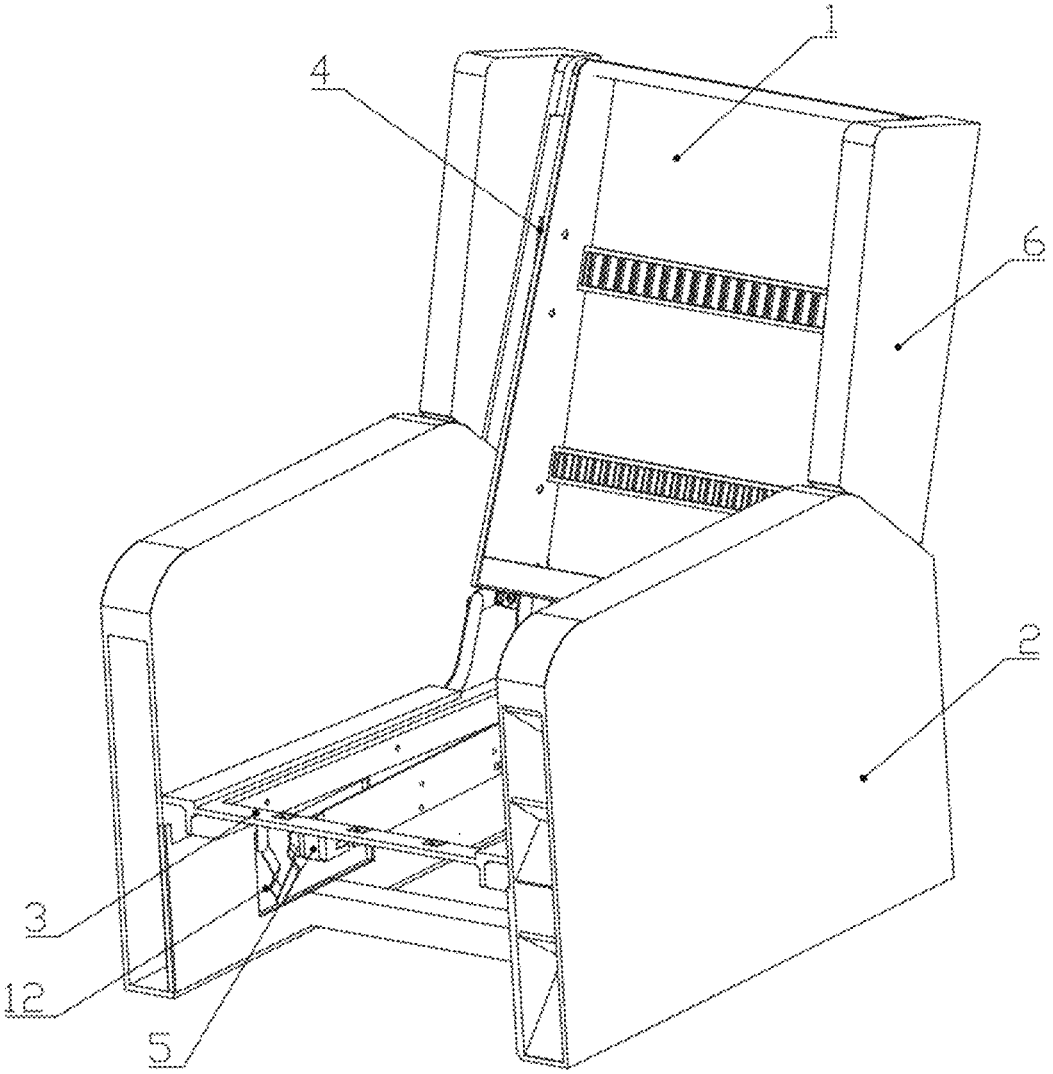
FIG. 1 is a schematic diagram of the overall structure of a preferred embodiment of the present invention.

Backrest frame (1); Armrest (2); Seat frame component (3); Splicing piece (4); Supporting piece (5); Backrest flange (6); Connecting part (11); Mounting part (12); Reinforcing rib (13); First connector (41); Second connector (42); Movable frame component (51); Groove (111); Top surface (112); Bottom surface (113); First side surface (114); Second side surface (115); Concave structure (121); Limit post (122); First bottom plate (411); Guide rail (412); Guide groove (413); First connecting surface (414); Second connecting surface (415); Second bottom plate (421); guide bar (422); Third bottom plate (511); Chute (512); Bearing edge (513); Positioning hole (514).

DESCRIPTION OF EMBODIMENTS

The technical solutions in the embodiment of the application will be clearly and completely described below with reference to the drawings in the embodiment of the application. Obviously, the described embodiment is only a part of the embodiment of the application, but not the whole embodiment. Based on the embodiments in this application, all other embodiments obtained by those skilled in the art without creative labor belong to the protection scope of this application.

Reference to "an example" or "an embodiment" herein means that a particular feature, structure or characteristic described in connection with an embodiment or an embodiment can be included in at least one embodiment of this application. The appearance of this phrase in various places in the specification does not necessarily refer to the same embodiment, nor is it an independent or alternative embodiment mutually exclusive with other embodiments. It is understood explicitly and implicitly by those skilled in the art that the embodiments described herein can be combined with other embodiments.

In this specification, for the sake of convenience, words and expressions indicating orientation or positional relationship such as "middle", "upper", "lower", "front", "rear", "vertical", "horizontal", "top", "inner" and "outer" are used to illustrate the positional relationship of constituent elements with reference to the attached drawings, only for the convenience of description. The positional relationship of the constituent elements is appropriately changed according to the direction of the described constituent elements. Therefore, it is not limited to the words and expressions described in the specification, and can be replaced appropriately according to the situation.

As shown in FIG. 1 to FIG. 9, the present invention provides a sofa structural frame, which includes a plurality of sofa modules, seat frame components 3, splicing pieces 4 and supporting pieces 5, wherein the sofa modules include a backrest frame 1 and armrests 2 integrated by a molding process. In this embodiment, the sofa modules have a generally hollow interior by plastic molding; the armrests 2 are arranged on both sides of the backrest frame 1 by the splicing pieces 4; and the seat frame component 3 is arranged between the armrests 2 on both sides by the supporting pieces 5. Connecting parts 11 are formed on the surfaces of the armrest 2 and the backrest frame 1, and a mounting part 12 is formed on the surface of the armrest 2. The splicing pieces 4 include a first connector 41 and a second connector 42 which are connected with each other, and the supporting pieces 5 are configured to be connected with the mounting part 12 and the seat frame component 3 respectively in a clamping manner;

The first connector 41 and the second connector 42 are both configured to have a shape that is matched with the connecting part 11 and are connected with the connecting part 11 by means of clamping, and the supporting pieces 5 are configured to have a shape that is matched with the mounting part 12.

The sofa module has a generally hollow internal structure, which not only reduces the overall weight, but also saves the material cost. The reinforcing ribs 13 with inward concave surfaces further enhance the structural strength of the module. These ribs 13 increase the rigidity and bending resistance of the surface, which makes the whole sofa module more stable and not easy to deform when bearing external forces. In addition, the design of the reinforcing ribs 13 can effectively disperse and absorb the external impact force, and prolong the service life of the sofa.

Figure 2:
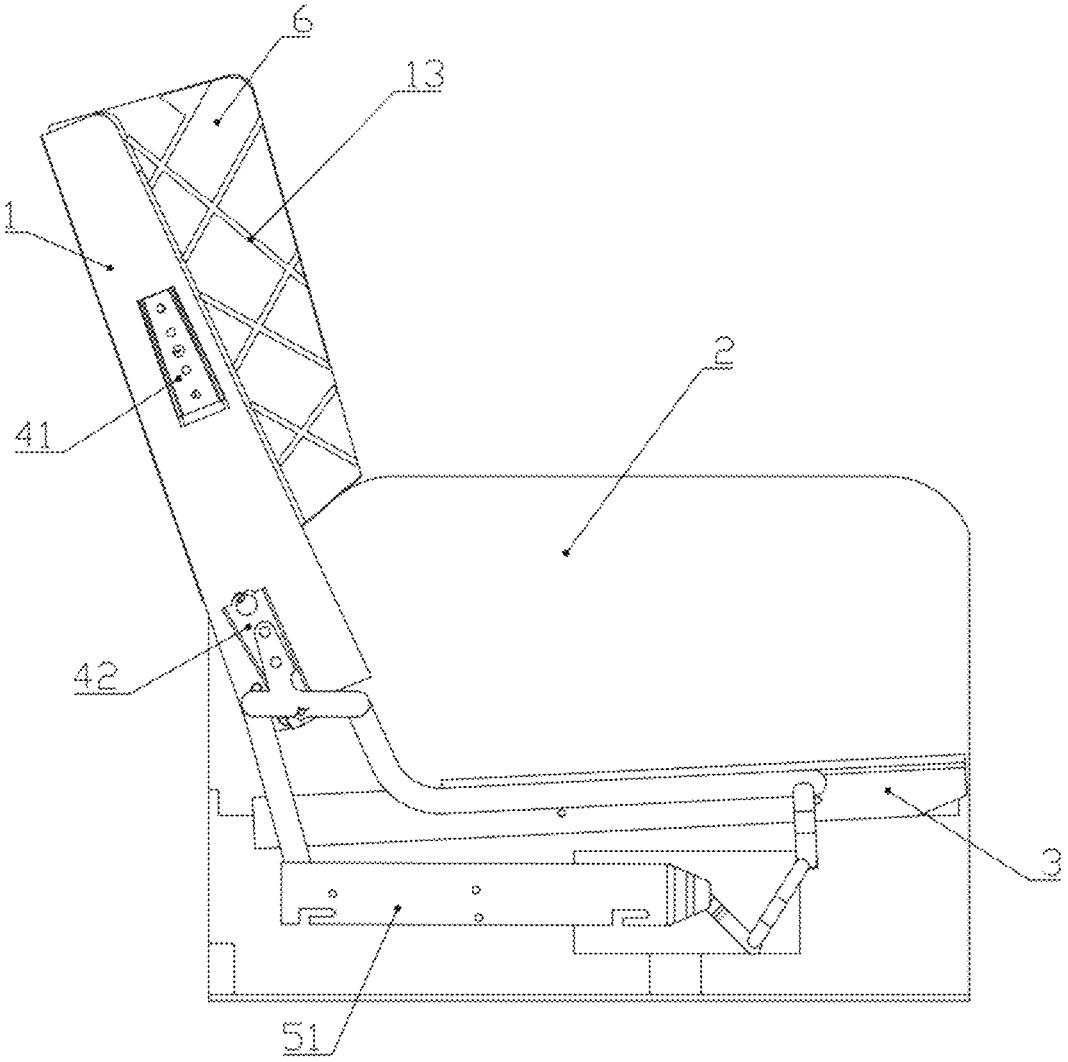
FIG. 2 is a partial structural diagram of a preferred embodiment of the present invention.

As shown in FIG. 1 and FIG. 2, both sides of the backrest frame 1 are firmly connected with backrest flanges 6 by the splicing pieces. This design not only enhances the overall stability of the backrest frame 1, but further provides additional support and protection to prevent the backrest from loosening or shifting during use. The existence of the backrest retaining edge 6 makes the sofa more comfortable to use, and users can lean on the backrest and enjoy better supporting effect.

The design of the supporting piece 5 includes a movable frame component 51, which makes the structure of the sofa more flexible and adjustable. The seat frame component 3 is fixedly installed on the movable frame component 51 to ensure the stability and durability of the seat frame. The movable frame component 51 is rotatably connected with the second connector 42, and the backrest frame 1 is provided with the first connector. The backrest frame is connected with the movable frame component 51 through the splicing piece 4, and these connectors are used for connecting the backrest frame 1 with the movable frame component 51. Through this connection, the backrest frame 1 can be firmly fixed on the movable frame component 51, and at the same time, it can be adjusted and swung to a certain extent to meet the needs of different users.

The seat frame component 3 and the movable frame component 51 are made of metal, and the metal material in the embodiment of the present invention is iron. In the actual production process, the seat frame component 3 and the movable frame component 51 can also be produced by using metals such as aluminum according to the needs of customers. Metal pressure-bearing parts and metal load-bearing parts are corrugated metal belts, which have load-bearing function.

In the embodiment of the present invention, the first connector 41 is used for connecting with the armrest 2, and the second connector 42 is used for connecting with the backrest frame 1. At the same time, a first connector 41 can be provided for connecting with the backrest frame 1, and a second connector 42 can be provided for connecting with the armrest 2.

Figure 3:
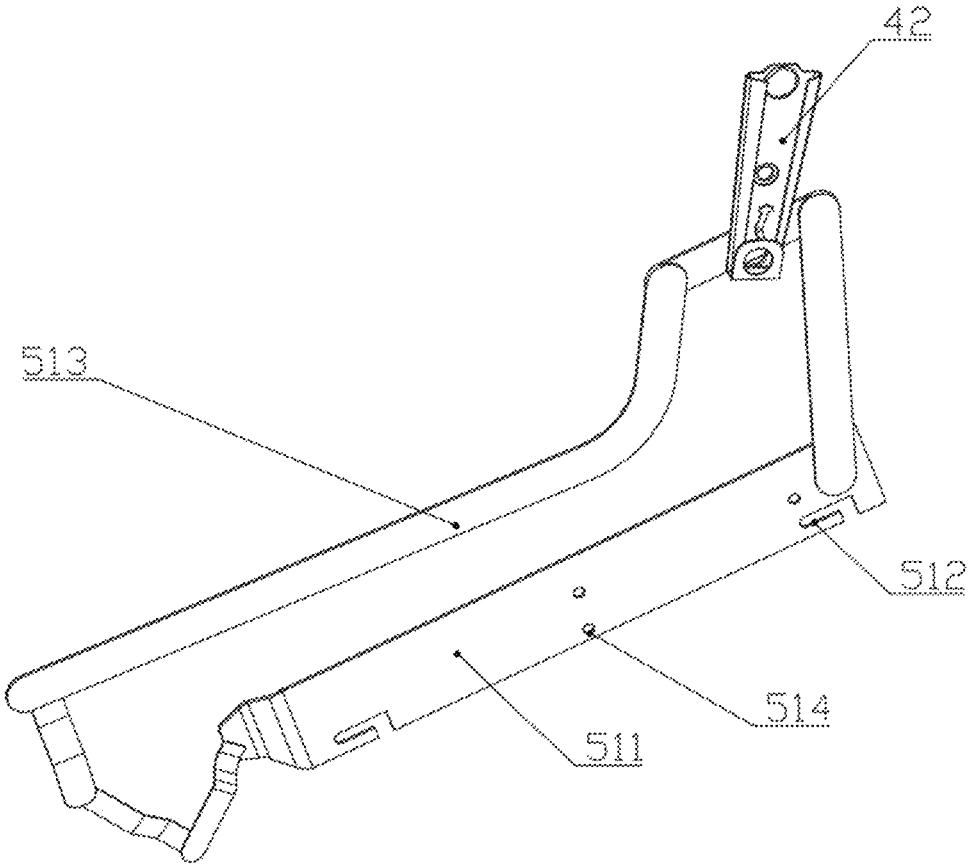
FIG. 3 is a schematic structural diagram of a movable frame component according to a preferred embodiment of the present invention.
Figure 4:
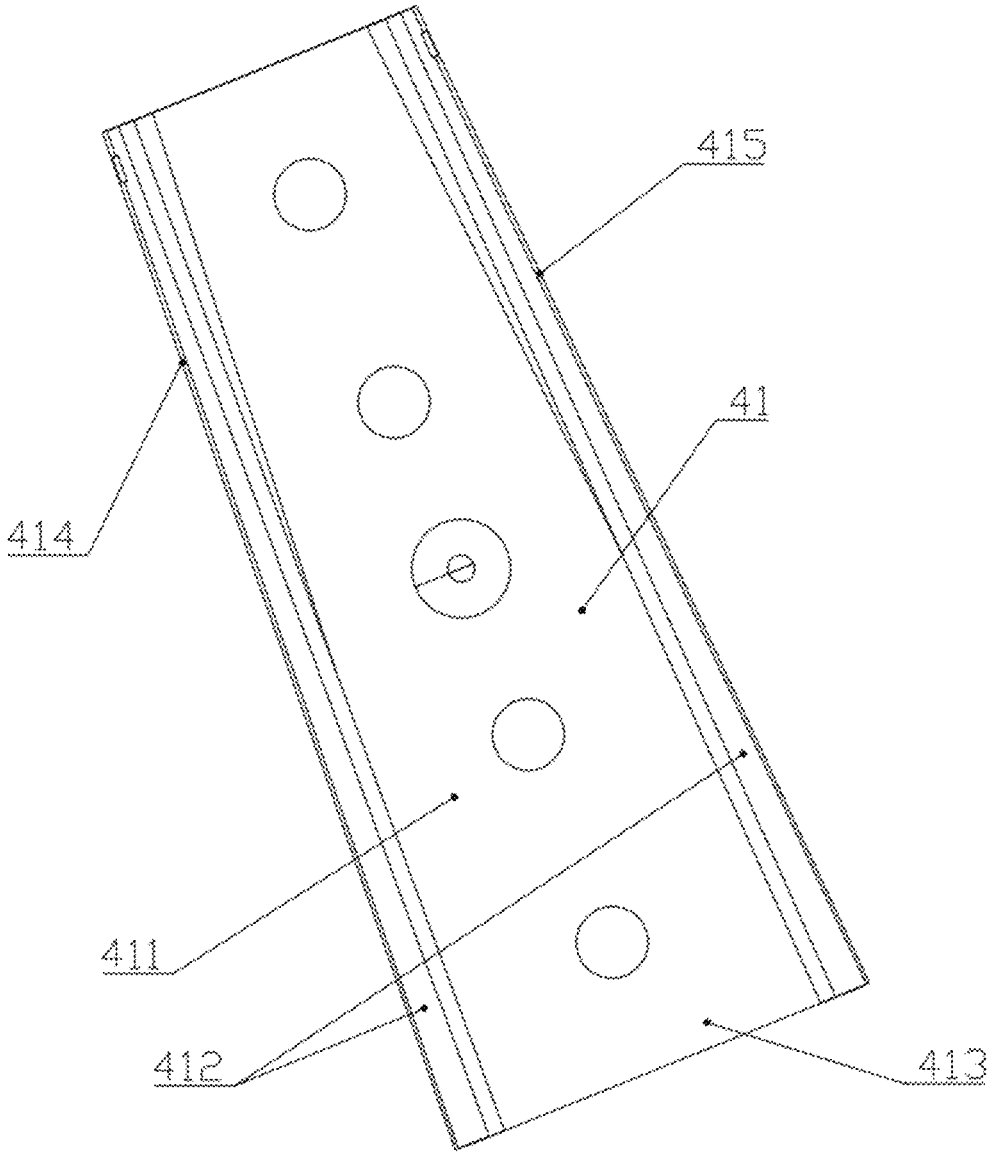
FIG. 4 is a schematic structural view of the first connector according to the preferred embodiment of the present invention.
Figure 5:
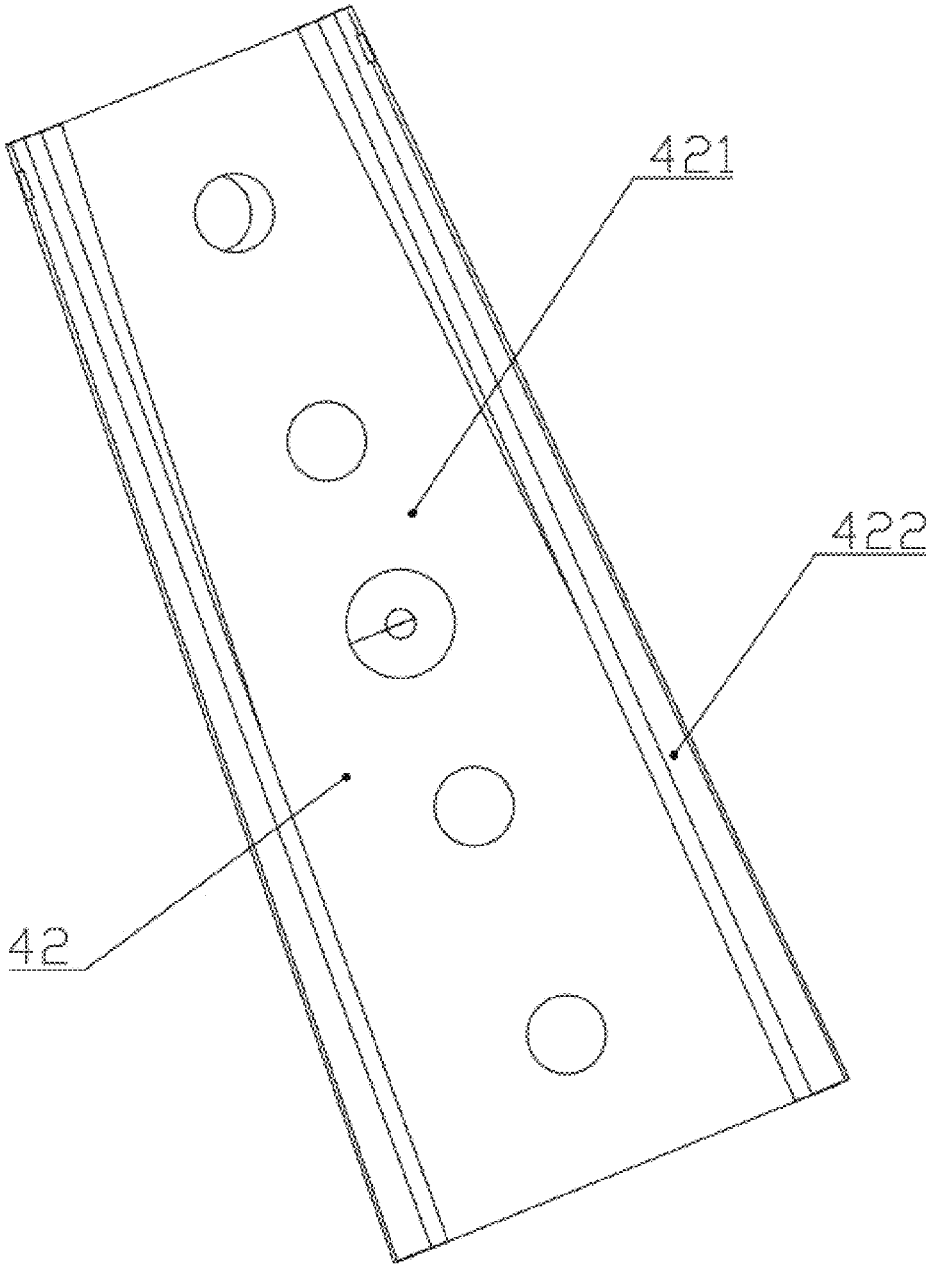
FIG. 5 is a schematic structural view of the second connector according to the preferred embodiment of the present invention.
Figure 6:
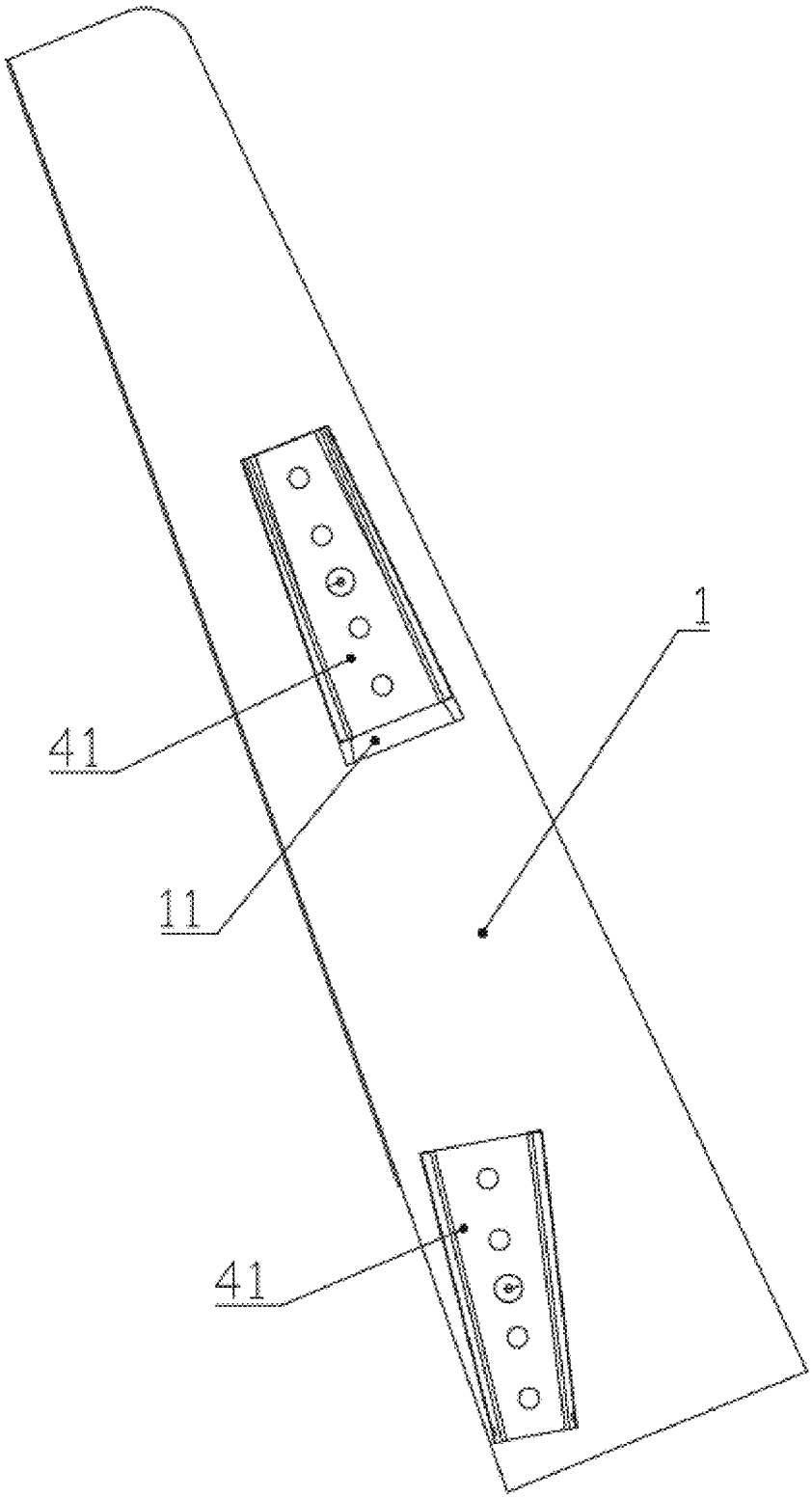
FIG. 6 is a schematic structural diagram of a backrest frame according to a preferred embodiment of the present invention.

As shown in FIG. 3, the first connector 41 has a first installation part and a slot part. The first installation part is configured to have a shape that is matched with the connecting part 11 and is connected with the connecting part 11 by means of clamping. The slot part is formed on the first installation part and connected with the second connector 42. The second connector 42 has a second installation part and a strip part which can be connected with the slot part. The second installation part is connected with the connecting part 11 in a clamping manner, and the strip part is connected with the slot part in a clamping manner. The first installation part includes a first bottom plate 411 and two guide rails 412 symmetrically arranged on the first bottom plate 411. The slot part includes a guide groove 413 provided between the two guide rails 412, and the width between the two guide rails 412 gradually decreases along the length direction of the first bottom plate 411. The second connector 42 includes a second bottom plate 421 and two guide bars 422 symmetrically arranged on the second bottom plate 421. The second bottom plate 421 is arranged in the guide groove 413, and the guide bars 422 on both sides constitute the strip part, and the guide bars 422 on both sides are respectively slidably inserted into and matched with the guide bars 412 on both sides. The width between the two guide bars 422 gradually decreases along the length direction of the second bottom plate 421.

Figure 7:
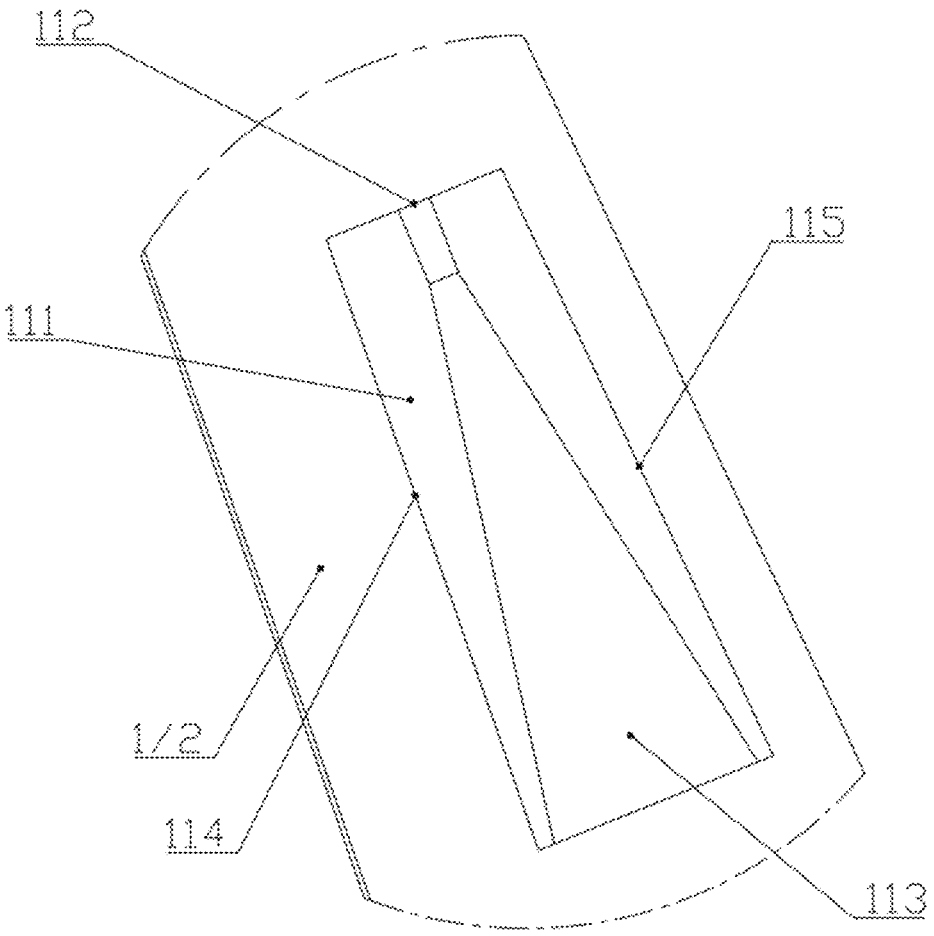
FIG. 7 is a schematic diagram of a groove structure in a preferred embodiment of the present invention.

As shown in FIG. 7, the connecting part 11 includes a groove 111 formed on the surface of the armrest 2 or backrest frame 1. The groove 111 has a specific shape and size, and the mounting part is matched with the groove 111 in shape, so that the first connector 41 is tightly assembled with the groove 111 on the surface of the armrest 2 or backrest frame 1.

In some embodiments (not shown), a vertically extending groove 111 is formed on the surface of the armrest 2 or backrest frame 1, which allows the first connector 41 to be detachably connected with the armrest 2 or backrest frame 1 in a plug-in manner. Preferably, the groove 111 has an open lower end to allow the installation part of the first connector 41 to be inserted into the groove 111 upward in the vertical direction from below the groove 111.

Further, the groove 111 includes a top surface 112 extending in the horizontal direction, a bottom surface 113 extending in the vertical direction, and a first side surface 114 and a second side surface 115 located at both sides of the bottom surface 113 and the top surface 112 and connected with the bottom surface 113 and the top surface 112. Corresponding to the groove 111, the installation part includes a first bottom plate 411 corresponding to the bottom surface 113 of the groove 111 and two guide rails 412. The outer sides of the two guide rails 412 form a first connecting surface 414 and a second connecting surface 415 corresponding to the first side surface 114 and the second side surface 115 of the groove 111, and the first connecting surface 414 and the second connecting surface 415 are connected with the first bottom plate 411 and located on both sides of the bottom surface 113.

In the process of mutual insertion between the installation part and the groove 111, when the installation part moves until the bottom surface 113, the top end of the first side surface 114 and/or the second side surface 115 contact the top surface 112, the top surface 112 prevents the installation part from moving upward, so that the relative movement between the groove 111 and the installation part is limited, so that the groove 111 and the installation part can be tightly assembled.

Figure 8:
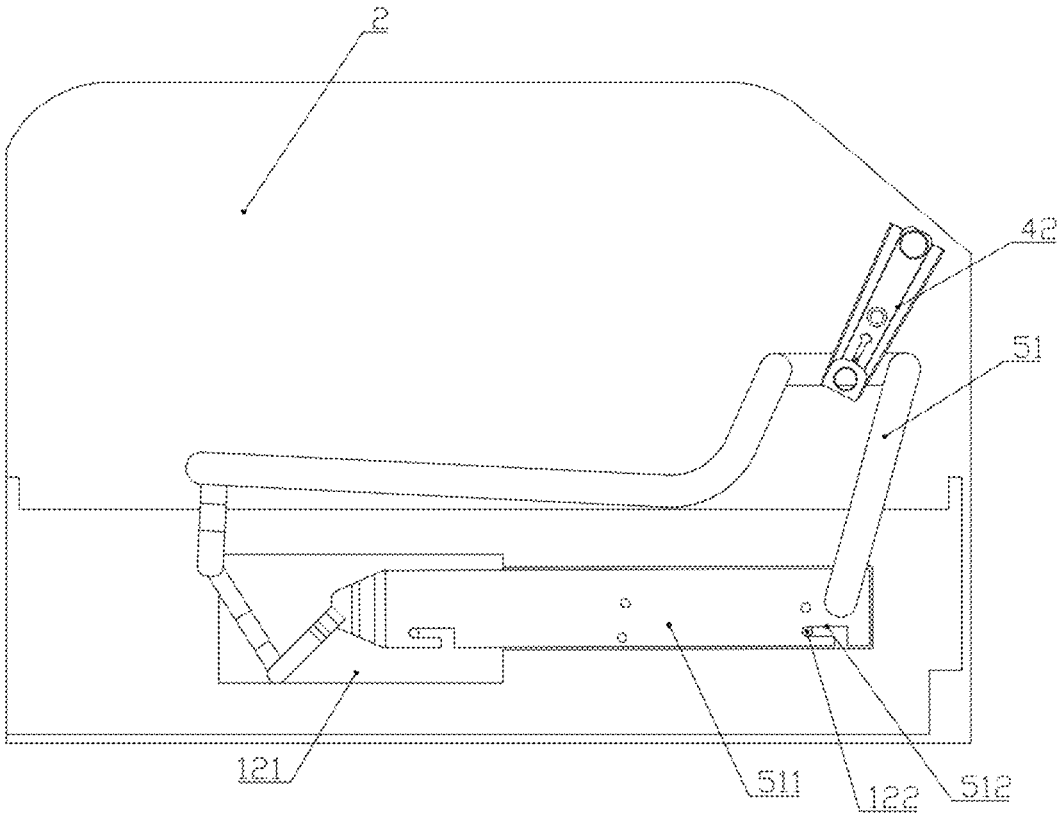
FIG. 8 is a schematic structural diagram of a mounting part according to a preferred embodiment of the present invention.
Figure 9:
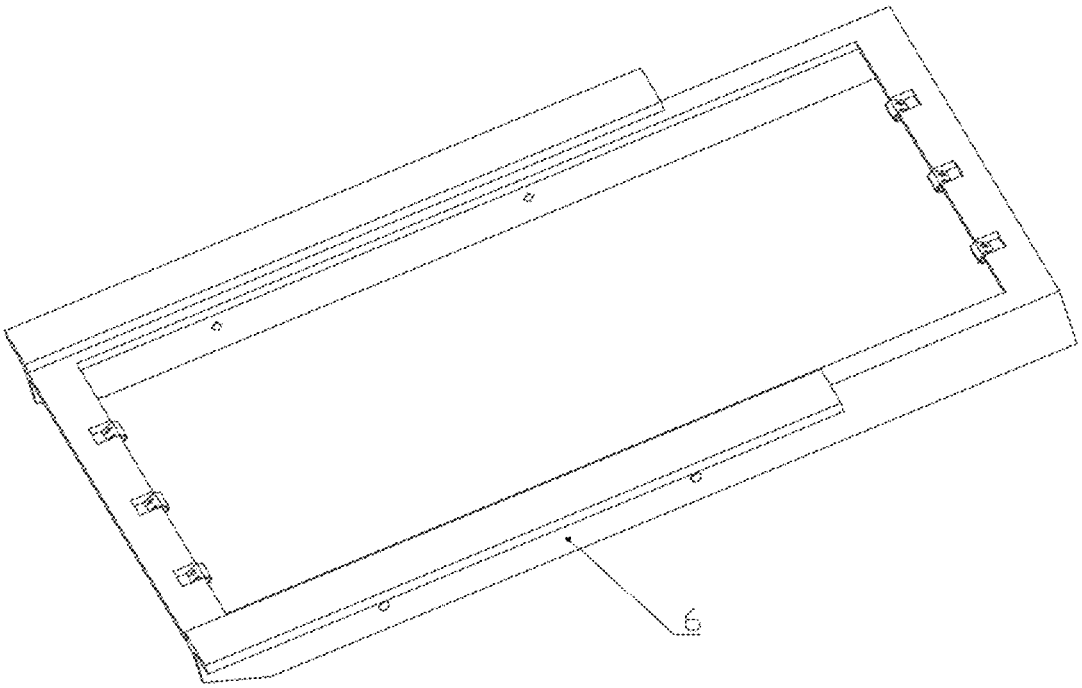
FIG. 9 is a schematic structural diagram of a seat frame component according to a preferred embodiment of the present invention.

As shown in FIGS. 3 and 8, the movable frame component 51 has a third installation part and a bearing part. The mounting part 12 includes a concave structure 121 and a limit post 122 formed on the surface of the armrest 2. The third installation part includes a third bottom plate 511 installed on the concave structure 121 and a chute 512 arranged on the third bottom plate 511. The third bottom plate 511 is configured to have a shape that partially cooperates with the concave structure 121, and the chute 512 is formed on the third bottom plate 511. In some embodiments (not shown), the movable frame component 51 has a third installation part and a bearing part. The mounting part 12 includes a concave structure 121 and a chute 512 formed on the surface of the armrest 2. The third installation part includes a third bottom plate 511 installed on the concave structure 121 and a limit post 122 arranged on the third bottom plate 511, and the third bottom plate 511 is configured to have a shape that is matched with the concave structure 121. The chute 512 is formed in the concave structure 121 and extends obliquely relative to the length direction of the armrest 2. The limit post 122 is installed in the chute 512 to form a clamping groove connection, that is, the limit post 122 is arranged on the movable frame component 51, and the chute 512 is arranged in the concave structure 121. Third bottom plate 511 is also provided with positioning hole 514 for positioning.

The bearing part is arranged on the third installation part and forms a bearing edge 513, which together with the bearing edge 513 of another supporting piece 5 forms an installation plane for mounting the seat frame component 3.

The design of the concave structure 121 and the chute 512 can be optimized according to the specific application requirements, such as increasing the depth and width of the chute 512 to improve the stability of the limit post 122 and the bearing capacity of the supporting pieces 5.

The design of the concave structure 121 and the chute 512 can be optimized according to the specific application requirements, for example increasing the depth and width of the chute 512 to improve the stability of the limit post 122 and the bearing capacity of the supporting piece 5. In order to improve the efficiency and convenience of component, the design of the groove 111 and concave structure 121 can be combined with automatic component technology. For example, in the production process, robots or automated equipment can be used to accurately assemble the groove 111 or the concave structure 121 and the connector, so as to ensure the quality and consistency of each connecting part 11. Moreover, the sofa module is made by plastic molding technology, and the nail-free assembling can be made by clamping with the connectors, so as to minimize the labor cost and realize the replacement of people by machines.

At the same time, a positioning guide structure, such as a guide groove 413 or a positioning pin, can be added in the design of the groove 111 to help the connector to be quickly aligned and inserted in the component process.

The clamping modes of the first connector 41 and/or the second connector 42 and the connecting part 11 include at least one of snap connection, clamping groove connection, interference connection and tenon-mortise connection, so that the tight connection without glue and screws is realized, nail-free component is carried out, and the labor cost is reduced.

The clamping modes of the bearing 5 and the mounting part 12 or the seat frame component 3 include at least one of snap connection, clamping groove connection, interference connection and tenon-mortise connection.

The present invention further provides a sofa structure, which includes a sofa structural frame and a soft cladding arranged outside the sofa structural frame.

The sofa structural frame includes a plurality of sofa modules, seat frame components 3, splicing pieces 4 and supporting pieces 5 which are combined to form a sofa frame, wherein the sofa modules include a backrest frame 1 and armrests 2 that are integratedly made by a molding process. In this embodiment, the sofa modules have generally hollow interior by plastic molding. The armrests 2 are arranged on both sides of the backrest frame 1 by the splicing pieces 4, and the seat frame components 3 are arranged between the armrests 2 on both sides by the supporting pieces 5. Connecting parts 11 are formed on the surfaces of the armrest 2 and the backrest frame 1, and a mounting part 12 is formed on the surface of the armrest 2. The splicing pieces 4 include a first connector 41 and a second connector 42 which are connected with each other, and the supporting pieces 5 are configured to be connected with the mounting part 12 and the seat frame component 3 respectively in a clamping manner.

The first connector 41 and the second connector 42 are both configured to have a shape that is matched with the connecting part 11 and are connected with the connecting part 11 by means of clamping, and the supporting pieces 5 are configured to have a shape that is matched with the mounting part 12.

The first connector 41 has a first installation part and a slot part. The first installation part is configured to have a shape that is matched with the connecting part 11 and is connected with the connecting part 11 in a clamping manner. The slot part is formed on the first installation part and connected with the second connector 42. The second connector 42 has a second installation part and a strip part which can be connected with the slot part. The second installation part is connected with the connecting part 11 in a clamping manner, and the strip part is connected with the slot part in a clamping manner. The first installation part includes a first bottom plate 411 and two guide rails 412 symmetrically arranged on the first bottom plate 411. The slot part includes a guide groove 413 opened between the two guide rails 412, and the width between the two guide rails 412 gradually decreases along the length direction of the first bottom plate 411. The second connector 42 includes a second bottom plate 421 and two guide bars 422 symmetrically arranged on the second bottom plate 421. The second bottom plate 421 is arranged in the guide groove 413, and the guide bars 422 on both sides form the strip part, and the guide bars 422 on both sides are respectively slidably inserted into and matched with the guide bars 412 on both sides. The width between the two guide bars 422 gradually decreases along the length direction of the second bottom plate 421.

The connecting part 11 includes a groove 111 formed on the surface of the armrest 2 or backrest frame 1, and the groove 111 has a specific shape and size. The installation part is matched with the groove 111 in shape, so that the first connector 41 is tightly assembled with the groove 111 on the surface of the armrest 2 or backrest frame 1.

The technical means disclosed in the scheme of the present invention are not limited to the technical means disclosed in the above embodiments, but also include the technical scheme composed of any combination of the above technical features. It should be pointed out that for those skilled in the art, several improvements and embellishments can be made without departing from the principle of the present invention, and these improvements and embellishments are also regarded as falling within the protection scope of the present invention.

What is claimed is:

1. A sofa structural frame, comprising a plurality of sofa modules, seat frame components, splicing pieces and supporting pieces which are combined to form a sofa frame, wherein the sofa modules comprise a backrest frame and armrests made by a molding process; the armrests are arranged on both sides of the backrest frame by the splicing pieces, and the seat frame components are arranged between the armrests on both sides by the supporting pieces; and wherein connecting parts are formed on the surfaces of the armrests and the backrest frame, and a mounting part is formed on the surface of the armrest; the splicing pieces comprise a first connector and a second connector which are connected with each other; and the supporting pieces are configured to be respectively connected with the mounting part and the seat frame component in a clamping manner; and wherein the first connector and the second connector are both configured to have a shape that is mutually matched with the connecting part and are connected with the connecting part in a clamping manner, and the supporting pieces are configured to have a shape that is mutually matched with the mounting part.

2. The sofa structural frame according to claim 1, wherein the sofa modules have a generally hollow interior by plastic molding, and the surface thereof is concavely molded with reinforcing ribs.

3. The sofa structural frame according to claim 1, wherein the first connector is used for connecting with the armrests, and the second connector is used for connecting with the backrest frame; alternatively, the first connector is used for connecting with the backrest frame, and the second connector is used for connecting with the armrests.

4. The sofa structural frame according to claim 1, wherein the first connector has a first installation part and a slot part, the first installation part is configured to have a shape that is matched with the connecting part and is connected with the connecting part in a clamping manner, and the slot part is formed on the first installation part and connected with the second connector.

5. The sofa structural frame according to claim 4, wherein the second connector has a second installation part and a strip part which can be connected with the slot part; and the second installation part is connected with the connecting part in a clamping manner, and the strip part is connected with the slot part in a clamping manner.

6. The sofa structural frame according to claim 5, wherein the first installation part comprises a first bottom plate and two guide rails symmetrically arranged on the first bottom plate; the slot part comprises a guide groove arranged between the two guide rails, and a width between the two guide rails gradually decreases along the length direction of the first bottom plate.

7. The sofa structural frame according to claim 6, wherein the second connector comprises a second bottom plate and two guide bars symmetrically arranged on the second bottom plate; the second bottom plate is arranged in the guide groove, and the guide bars at two sides constitute the strip part; and the guide bars at two sides are respectively inserted into and matched with the guide rails at two sides in a sliding manner.

8. The sofa structural frame according to claim 7, wherein the width between the two guide bars gradually decreases along the length direction of the second bottom plate.

9. The sofa structural frame according to claim 4, wherein the connecting part comprises a groove formed on the surface of the armrest or the backrest frame, and the first installation part is matched with the groove in shape, so that the first connecting part is tightly assembled with the groove on the surface of the armrest or the backrest frame.

10. The sofa structural frame according to claim 1, wherein both sides of the backrest frame are connected with backrest flanges by the splicing pieces.

11. The sofa structural frame according to claim 10, wherein the supporting piece comprises a movable frame component, and the seat frame component is fixedly installed on the movable frame component; the movable frame component is rotatably connected with the second connector, the backrest frame is provided with the first connector, and the backrest frame is connected with the movable frame component by the splicing pieces.

12. The sofa structural frame according to claim 11, wherein the movable frame component has a third installation part and a bearing part; the mounting part comprises a concave structure and a limit post formed on the surface of the armrest; the third installation part comprises a third bottom plate installed on the concave structure and a chute arranged on the third bottom plate; the third bottom plate is configured to have a shape that is partially matched with the concave structure; chute are formed on the third bottom plate and the clamping groove is installed in the chute to form a clamping groove connection.

13. The sofa structural frame according to claim 12, wherein the bearing part is arranged on the third installation part and forms a bearing edge, and the bearing edge and the bearing edge of another supporting piece together constitute an installation plane for installing the seat frame component.

14. The sofa structural frame according to claim 1, wherein a clamping mode of the first connector and/or the second connector and the connecting part comprises at least one of snap connection, clamping groove connection, interference connection and tenon-mortise connection.

15. The sofa structural frame according to claim 1, wherein a clamping mode of the supporting piece and the mounting part or the seat frame component comprises at least one of snap connection, clamping groove connection, interference connection and tenon-mortise connection.

16. A sofa structural frame, comprising a plurality of sofa modules constituting a sofa frame and splicing pieces installed on the sofa modules, wherein the splicing pieces are detachably connected; the surfaces of the sofa modules are formed with connecting parts through a molding process; the splicing pieces comprise splicing pieces and installation parts; the installation parts are all configured to have a shape that is matched with the connecting parts and are connected with the connecting parts in a clamping manner; and the splicing piece is detachably connected with the connecting part of another splicing piece through the connecting part.

17. The sofa structural frame according to claim 16, wherein the sofa modules have a generally hollow interior by plastic molding.

18. The sofa structural frame according to claim 16, wherein the splicing pieces comprise at least one of a first connector and a second connector which are connected with each other, and the first connector and the second connector are connected with each other.

19. The sofa structural frame according to claim 18, wherein the first connector has a first installation part and a slot part; the first installation part comprises a first bottom plate and two guide rails symmetrically arranged on the first bottom plate; the slot part comprises a guide groove provided between the two guide rails, and a width between the two guide rails gradually decreases along the length direction of the first bottom plate; and the slot part is formed on the first installation part and connected with the second connector; and the second connector comprises a second bottom plate and two guide bars symmetrically arranged on the second bottom plate; the second bottom plate is arranged in the guide groove, and the guide bars on both sides are respectively inserted into and matched with the guide rails at two sides in a sliding manner.

20. A sofa structure, comprising a sofa structural frame and a soft cladding arranged outside the sofa structural frame;

wherein the sofa structural frame comprises a plurality of sofa modules, seat frame components, splicing pieces and supporting pieces which are combined to form a sofa frame, wherein the sofa modules comprise a backrest frame and armrests made by a molding process, the armrests are arranged on both sides of the backrest frame by the splicing pieces, and the seat frame components are arranged between the armrests on both sides by the supporting pieces; and connecting parts are formed on the surfaces of the armrests and the backrest frame, and a mounting part is formed on the surface of the armrest; the splicing pieces comprise a first connector and a second connector which are connected with each other; and the supporting pieces are configured to be respectively connected with the mounting part and the seat frame component in a clamping manner; and wherein, the first connector and the second connector are both configured to have a shape that is mutually matched with the connecting part and are connected with the connecting part in a clamping manner, and the supporting pieces are configured to have a shape that is mutually matched with the mounting part.

* * * * *